US007604320B2

(12) United States Patent
Robertson et al.

(10) Patent No.: US 7,604,320 B2
(45) Date of Patent: Oct. 20, 2009

(54) MAINTENANCE ON A HAND-HELD PRINTER

(75) Inventors: Douglas Laurence Robertson, Lexington, KY (US); Barry Baxter Stout, Lexington, KY (US); Randal Scott Williamson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 415 days.

(21) Appl. No.: 11/315,449

(22) Filed: Dec. 22, 2005

(65) Prior Publication Data

US 2007/0146411 A1 Jun. 28, 2007

(51) Int. Cl.
*B41J 2/165* (2006.01)
*B41J 3/36* (2006.01)

(52) U.S. Cl. ..... 347/23; 347/109

(58) Field of Classification Search ..... 347/10, 347/17, 19, 23, 29–35, 109
See application file for complete search history.

(56) References Cited

U.S. PATENT DOCUMENTS 5,428,380 A * 6/1995 Ebisawa ..... 347/35
5,501,535 A 3/1996 Hastings et al.
5,627,572 A 5/1997 Harrington et al.
5,634,730 A 6/1997 Bobry et al.
5,736,995 A * 4/1998 Bohorquez et al. ..... 347/14
5,736,998 A 4/1998 Caren et al.
5,793,388 A * 8/1998 Martinson et al. ..... 347/19
5,847,726 A * 12/1998 Hori ..... 347/23
6,095,632 A * 8/2000 Kobayashi et al. ..... 347/23
6,231,156 B1 * 5/2001 Ono ..... 347/24
6,305,778 B1 * 10/2001 Kobayashi et al. ..... 347/30
6,312,124 B1 * 11/2001 Desormeaux ..... 347/109
6,328,413 B1 12/2001 Rutland et al.
6,494,560 B1 * 12/2002 Seshimo et al. ..... 347/23
6,557,971 B1 5/2003 Vega et al.
6,652,056 B2 * 11/2003 Shioya ..... 347/12
6,764,159 B2 * 7/2004 Endo ..... 347/19
6,896,350 B2 5/2005 Gomez et al.

* cited by examiner

*Primary Examiner*—shih-wen hsieh
(74) *Attorney, Agent, or Firm*—John Victor Pezdek

(57) ABSTRACT

Method of printing from a printer, where the printer includes one or more maintenance firings from a printhead nozzle. Formatting a print job to be printed in determining which nozzles on a printhead require maintenance during printing of the print job. Modifying the formatted print job to include one or more maintenance firings for the nozzles requiring maintenance.

17 Claims, 2 Drawing Sheets

MAINTENANCE ON A HAND-HELD PRINTER

TECHNICAL FIELD

The present invention relates to apparatuses and methods for performing maintenance on a handheld ink jet printer.

BACKGROUND OF THE INVENTION

Ink jet printing is a conventional technique by which printing is accomplished without contact between the printhead and the substrate, or medium, on which the desired print characters are deposited. Such printing is accomplished by ejecting ink from an ink jet printhead of a printing apparatus via numerous methods which employ, for example, pressurized nozzles, electrostatic fields, piezo-electric elements and/or heaters for vapor phase droplet formation.

Recently, there has been a desire for a hand-held printer, which utilizes the same ink jet printing technology. Performance of a conventional printhead relies typically on proper maintenance steps to insure the nozzles of the printhead do not dry up or clog. In addition, "spitting" or firing the printhead allows the heater to maintain proper temperatures. Improperly maintained printheads can cause noticeable banding and light/dark regions throughout a printed image. Periodic spitting of the nozzles in the spit station is one typical method for preventing or curing reliability problems caused by nozzle inactivity. Spitting is the ejection of non-printing ink drops during printing operations and during routing servicing of the print cartridge. Typically, spitting is done in a spittoon. However, a hand-held ink jet printer may not have space for a spittoon or dedicated maintenance station. For example, the maintenance station may be part of the cradle/docking station of the hand-held ink jet printer. As such, while a conventional printer can perform maintenance anytime without affecting print quality, position is lost with a hand-held printer when performing maintenance since a hand-held printer would require to be lifted off the media and placed in a cradle to service the printheads. This can place a limitation on the user on how long they can print before stopping the job and performing maintenance. In addition, since position may be lost during the maintenance operation, it is difficult to continue the printed pattern. Depending on the printing speed in which nozzles fire, the printed pattern may be limited to a few feet. For many users, this will be unacceptable. One solution known in the art to attempt to overcome this opportunity for improvement is to fire the individual nozzle when a pre-determined time has elapsed between firings of the same nozzle while performing a print job.

In order for the hand-held ink jet printer to resemble a conventional ink printer in shape and size, the hand-held printer has space limitations and as such minimal complexity in design. As such, the hand-held ink jet printer would typically require an external formatter to format the print job. In addition, due to the minimal complexity in design, the ink jet printer typically would not comprise the ability to track in real-time individual nozzle firings and monitor the time between firings of each nozzle. As such, there is a need for a new method of printing with a hand-held ink jet printer which includes one or more maintenance firings from a printhead nozzle. Accordingly, improved methods of printing are desired.

SUMMARY OF THE INVENTION

The present invention relates to new and improved methods and apparatuses for performing maintenance operations with a hand-held printer. In a described embodiment, a printing method includes the step of adding predetermined maintenance operations into the formatting process of a job to be printed. As described herein, the formatting process is used to determine which nozzles on the printhead to fire and when to fire the nozzles.

In some embodiments, a print format process is enhanced to include a determination as to which nozzles, if any, on the printhead will require maintenance during printing of the print job. Formatting is further modified so that a formatted print job includes a determination of when the nozzles that require maintenance are fired so as no to disturb the printing operation.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

Figure 1:
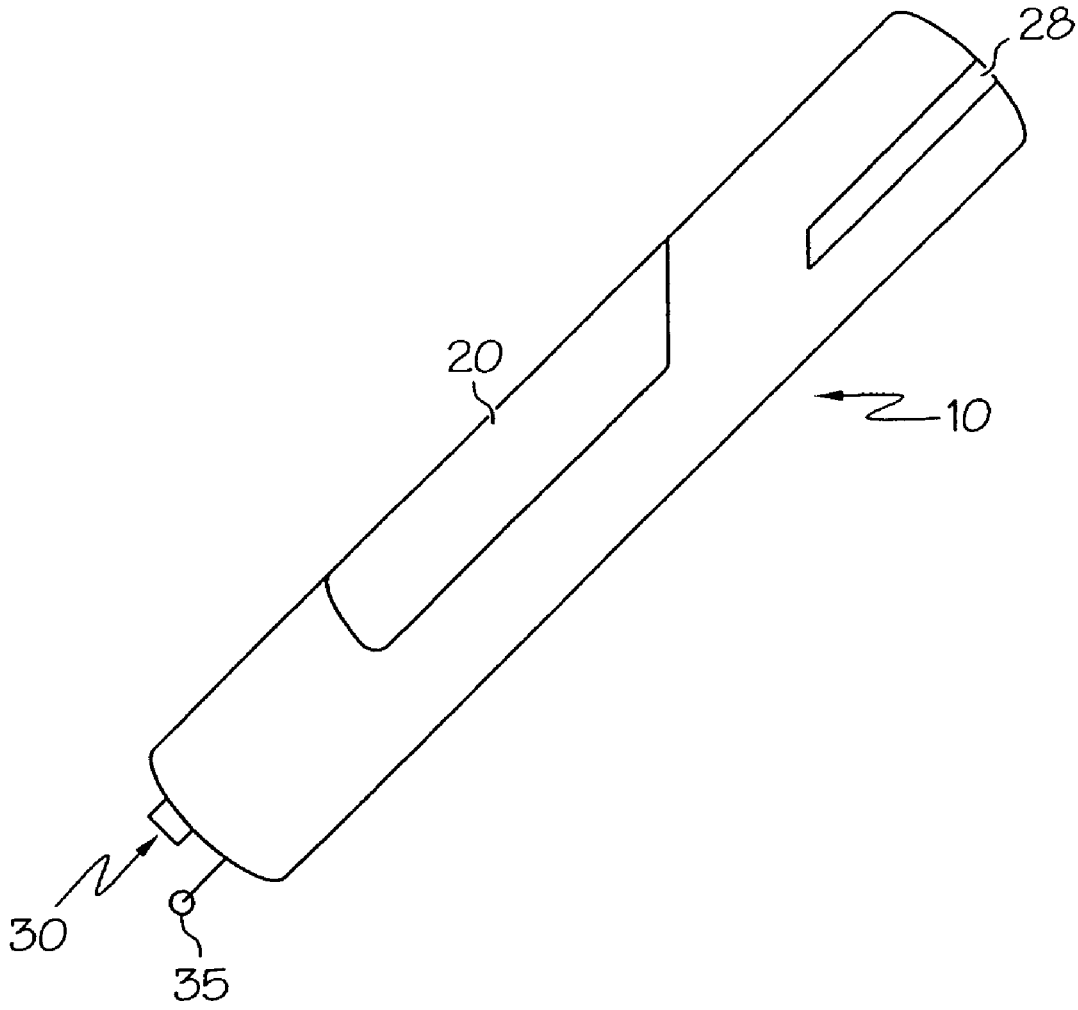
FIG. 1 is a schematic illustration of an exemplary ink jet printer according to a first embodiment of the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF THE INVENTION

Reference will now be made in detail to various embodiments which are illustrated in the accompanying drawings, wherein like numerals indicate similar elements throughout the views.

One embodiment of a hand-held printing apparatus is illustrated in FIG. 1. An ink jet printer 10 includes an ink chamber 20, and a printhead 30 in fluid communication with the ink chamber 20. In one embodiment, the ink jet printer 10 also includes a surface contact device 35 adapted to move along a surface of a substrate. Ink jet printer 10 may also include a communication link 28 for receiving a formatted print job. Various types of communication links 28 are known in the art and can be used with the present invention, such as a wired or wireless connection to an external device. In still other embodiments, printer 10 can be linked to a computer readable memory device such as a memory card.

The printer illustrated in FIG. 1 is but one illustrative example of a hand-held printing device. Another example of a printing device that is manually moved across a print medium is the Design Runner™ that offered by Xyron. One of ordinary skill will readily recognize that embodiments of the present invention are equally advantageous when used with any printing apparatus that relies on a manual or hand-held movement of a printing apparatus. In contrast to conventional printers, where a motor controls the movement of a printhead and a controller (or other software application) handles the scheduling and performance of maintenance routines, no such electronic communication is typically available to indicate to a user that it is time to pause the printing operation to perform maintenance on a printhead.

In some embodiments, the hand-held printing apparatus 10 may be configured with an audio and/or visual indicator that indicates to a user when a printhead requires maintenance. In such an embodiment, the print formatting routine that determines when and where each nozzle will fire is enhanced to track the number of times each nozzle fires and uses this tracking (or drop count) data to determine when each nozzle requires maintenance. In some embodiments, printer 10 may be configured to provide an indication to a user that maintenance is required when the drop count for any nozzle hits a predetermined threshold that indicates a nozzle requires maintenance. In alternative embodiments, a printer 10 may not provide such an indication until a predetermined number of nozzles have reached a stage when maintenance is required.

In some embodiments, an audio and/or visual indication to a user may indicate that the user maintenance is immediately required. In other embodiments, an indicator may mean only that the user should perform maintenance on a printhead upon completion of a current printing operation.

The foregoing embodiments describe printing apparatuses and processes in which a user is required to take some action with regard to printhead maintenance. Such user action can take many forms, as will be apparent to one of ordinary skill, including moving a printer 10 to a maintenance area or maintenance station, or using a cloth or other material to wipe the printhead, to name a few.

Also described herein are additional embodiments of the present invention in which the print formatting operation is additionally enhanced so that some or all of the maintenance operations occur as part of the print job.

Figure 2:
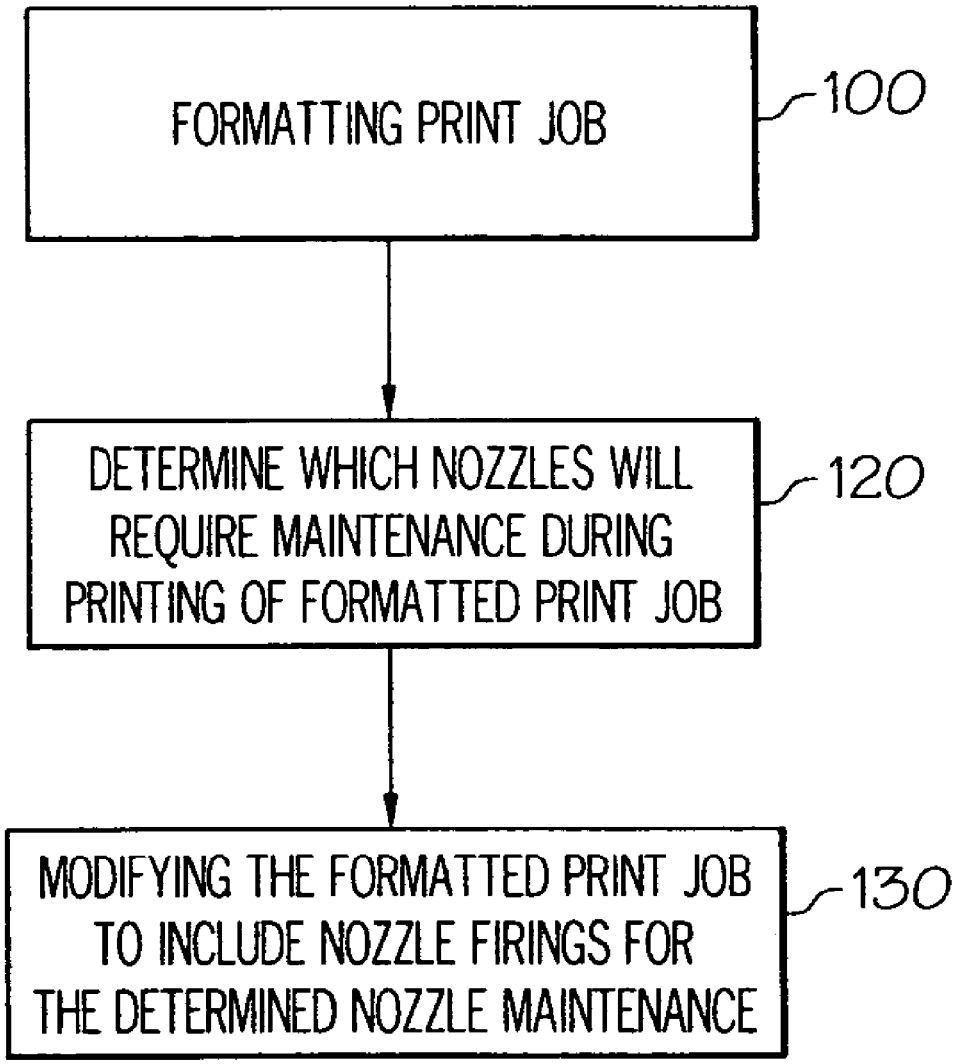
FIG. 2 is a schematic flowchart of an exemplary method according to another embodiment of the present invention.

One process for performing maintenance on a hand-held printer 10 in accordance with an embodiment of the present invention is illustrated in FIG. 2. In some instances, such a process can replace a maintenance and capping station (herein a "maintenance station") entirely, in other embodiments, processes such as that described below can augment a maintenance station.

At Step 100, a print job is formatted. Print formatting operations are known in the art and generally involve a generation of print instructions that indicate to a printer 10 when and where to fire ink to print a desired image. In some embodiments, the data generated by a print formatting operation is enhanced to track a frequency that nozzles are being used in a given print job. In some embodiments, this may provide a specific count of the number of ink drops ejected by each nozzle, or a lesser processor intensive embodiment is envisioned wherein a total number of drops ejected by the entire printhead (or some sub-grouping of nozzles) is calculated.

In some embodiments, the apparatus responsible for performing the formatting operation resides on an external device such as a computer. In such an embodiment, the external device receives a to-be-printed image, uses known processes to format the to-be-printed image into print instructions for use with the hardware of the printing device, and then enhances this process to perform the necessary drop counting algorithms described above. In other embodiments, the hand-held printing apparatus 10 may itself have the capability of formatting a print job. Such an embodiment might include, for example, a hand-held printing apparatus that has an ability to scan an image, and then store and print the scanned image. In such case, no external device is necessary to format the to-be-printed image. In still another alternative embodiment, the to-be-printed image can be stored in a preformatted form on a memory device or elsewhere.

The process for using the nozzle drop count to provide an audiovisual indicator to a user has already been described. In additional embodiments of the present invention, the formatting algorithm is further enhanced so that the spitting operation of a printhead maintenance routine can occur during a print operation as a scheduled part of the print job. In such an embodiment, additional steps are added to the formatting process to determine which nozzles require maintenance and when during a print operation the nozzles can be spitted without significant impact to the print output. In some cases, the nozzles requiring maintenance can be cleared in an area in which the ink ejected during the print operation would be undetectable due to the presence of other ink being used to print an image. Alternatively, the spitting of the nozzles that are being cleared can occur in such a way that the volume of ink being spitted in any particular area is so small as to be virtually undetectable.

The process used for determining which nozzles require maintenance is not limited to drop counts. In some embodiments, the act of determining which nozzles require maintenance includes monitoring a time period between expected firings of a selected nozzle to determine if it exceeds a predetermined threshold period. For example, in one exemplary embodiment, a nozzle should be fired approximately every 20 seconds of printing for proper maintenance schedule. After determining which nozzles require maintenance, the formatted print job is modified to include one or more maintenance firings. This modification can occur, for example, by inserting an instruction in an appropriate location in the print job to fire the selected nozzle.

In another embodiment, pre-fires or non-nucleating fires of a printhead are embedded in the print job much like the printing fires. The main difference is that ink is not fired from the print-head in a pre-fire, the nozzle heaters engage to a lesser extent to keep the nozzles at optimal temperature conditions. This substitutes for closed loop temperature control needed to maintain proper heating temperature of the printhead during operation. In some embodiments, timing of the pre-fires is based on the predicted thermal heating of past and future nozzle firings. As an example, firing the printhead under normal printing conditions raises the temperature of a printhead around the immediate region of the firing nozzles. If the nozzles remain unused, then the temperature falls below optimal conditions. By predicting the thermal loss as a function of time, pre-fires can bring the temperature back up to optimal levels for future ink ejection. As with actual nozzle fires, this information can be embedded in the instructions in a formatted print job.

As will be appreciated by one skilled in the art, other factors can be utilized in the determination of which nozzles on a printhead will require maintenance. For example, in one exemplary embodiment, a minimum user printing speed is assumed to help determine the time period between firings of each nozzle. As will be appreciated by one skilled in the art, the speed at which a user moves the inkjet printer across the printing substrate can affect the nozzle firing rate, such that a slow speed may require additional nozzle maintenance as compared to a fast speed. In one exemplary embodiment, the ink jet printer comprises a sensor to detect the speed at which the printer is moving during a print operation.

As noted above, the application used to format a print job can operate on an external device. The external device may comprise a computer, a docking station or other peripheral device with sufficient computing power to format the print job into the appropriate printer description language. In operation, a formatter program receives the document or image to be printed. The formatting comprises determining which nozzles on the printhead to fire and when to fire the nozzles. After determining which nozzles on the printhead will be fired and when, the formatting program then determines which nozzles, if any, will require maintenance during printing of the print job. In some embodiments, this can involve utilizing an estimated printing speed and calculating the time between each nozzle printing against a predetermined threshold such as 20 seconds. For every nozzle that requires maintenance, the formatting program modifies the print job to include one or more maintenance firings for the nozzles requiring maintenance. In one exemplary embodiment, the speed of the user movement of the ink jet printer as measured by the surface contact sensor from previous printings is utilized by the formatter program to predict an estimate printing speed and determines when nozzles may require maintenance.

In another exemplary embodiment, the formatter seeks to perform the maintenance firing during an area of high nozzle density firing such as to minimize the visibility of the maintenance firing. For example, the formatter program searches through the formatted print job to find an appropriate location to insert additional nozzle firing instructions. Exemplary locations include dark regions with high nozzle firing density. In another exemplary embodiment, if the formatter can not locate regions of high density, then it spaces nozzle firings so consecutive nozzles do not fire at the same time which would cause noticeable artifacts. Still another alternative location for maintenance fires is to extend a proximal print pattern by one or two nozzle dots. Such extensions would have minimal impact on the printed image quality and would appear imperceptible to most users.

In one embodiment of the present invention, after the maintenance firings are inserted into a modified print job, the modified print job is stored to a removable memory source such as flash memory. In one exemplary embodiment, the flash memory is inserted into the communication link 28 of the hand-held ink jet printer. In another exemplary embodiment, the formatted print job is transferred through the communication link to the hand-held ink jet printer.

In an illustrative embodiment, the formatter utilizes the following algorithm to determine which nozzles may require maintenance.

Example algorithm:

```
if (NozzleIdleTime > 15)
{
    P = k1(p_density) + k2 (p_others) + k3(p_temp) + k4(p_time);
    if (P > 0.8)
    {
        FireNozzle( );
    }
}
```

where:

$P$ = probability to fire a certain nozzle $p_{density}$ = density of swath firing around dot location in question $p_{others}$ = number of other maintenance dots at that time $p_{time}$ = idle time of nozzle $p_{temp}$ = parameter associated with maintaining proper head temperature $k_1, \ldots, k_4$ = weightings on values The foregoing description of the various embodiments and principles of the invention has been presented for the purposes of illustration and description. It is not intended to be exhaustive or to limit the invention to the precise forms disclosed. Many alternatives, modifications and variations will be apparent to those skilled in the art. For example, some principals of the invention may be used in different ink jet printer configurations. Moreover, although multiple inventive concepts have been presented, such aspects need not be utilized in combination, and various combinations of inventive aspects are possible in light of the various embodiments provided above. Accordingly, the above description is intended to embrace all alternatives, modifications, combinations, and variations that have been discussed or suggested herein, as well as all others that fall within the principals, spirit and broad scope of the invention as defined by the claims.

What is claimed:

1. A method of performing maintenance on a printer that is manually moved across a surface to print a user-desired output image, said method comprising:

generating print instructions for said user-desired output image that dictate when and where each of a plurality of nozzles will fire to print said user-desired output image;

determining, while printing said user-desired output image, which of said plurality of nozzles requires a maintenance action; and including in said print instructions at least one instruction related to a performance of said maintenance action, said at least one instruction related to the performance of said maintenance action comprising including a print instruction that causes a nozzle to fire in a high density region of said image at least once to clear said nozzle with said maintenance action being performed during printing of the user-desired output image.

2. The method of claim 1, wherein the step of determining which of said plurality of nozzles requires a maintenance action comprises determining if a time period between anticipated firings of a nozzle is greater than a predetermined period.

3. The method of claim 1, wherein said step of determining which of said plurality of nozzles requires a maintenance action comprises assuming a minimal user printing speed to determine a time period between firings of each nozzle.

4. The method of claim 1, wherein said step of generating print instructions occurs on an external device and said print instructions are transferred electronically to said printer.

5. The method of claim 4, further comprising storing said print instructions on a computer readable media and inserting said computer readable media into said printer.

6. The method of claim 1, wherein said step of determining which of a plurality of nozzles require maintenance comprises tracking a drop count for said plurality nozzles and identifying which of said drop counts exceed a predetermined threshold.

7. The method of claim 1, wherein said at least one instruction related to a performance of a maintenance action comprises an instruction that causes a non-nucleating fire of a nozzle.

8. The method of claim 7, wherein said step of determining which of said plurality of nozzles requires a maintenance action comprises monitoring a predicted thermal temperature of each of said plurality of nozzles.

9. The method of claim 1, wherein said step of determining which of said plurality of nozzles requires maintenance comprises utilizing an algorithm for each of the plurality of nozzles as follows:

```
if(NozzleIdleTime> 15)
{
    P = k1(p_density) + k2(p_others) + k3(p_temp) +
    k4(p_time);
    if(P > 0.8)
    {
        FireNozzle( );
    }
}
```

wherein P is a probability to fire a particular nozzle, $p_{dnsity}$ is a density of a swath firing around a dot location, $p_{others}$ is a number of other maintenance dots at that time, $p_{time}$ is an idle time of the particular nozzle, $p_{temp}$ is a parameter associated with maintaining a predetermined target printhead temperature, and $k_1$, $k_2$, $k_3$ and $k_4$ are weightings on said $p_{dnsity}$, $p_{others}$, $p_{temp}$, and $p_{time}$ values.

10. A method of performing maintenance on a hand-held printer, said hand-held printer including a printhead with a plurality of nozzles and adapted to print a user-desired output image as said printer is manually moved across a surface, comprising:

generating a first set of print instructions that cause said hand-held printer to print said user-desired output image, said print instructions identifying a firing order for said plurality of nozzles;

analyzing, while printing said user-desired output image, said firing order for at least some of said plurality of nozzles to determine when one or more of said plurality of nozzles are likely to require a maintenance action; and modifying said first set of print instructions such that said hand-held printer will perform at least one maintenance action as said hand-held printer is manually moved across said surface while printing said user-desired output image.

11. The method of claim 10, wherein said step of analyzing said firing order comprises tracking a number of times each of said plurality of nozzles is fired.

12. The method of claim 10, wherein said step of analyzing said firing order comprises calculating an estimated temperature of at least one of said plurality of nozzles as said image is printed.

13. The method of claim 12, wherein said step of analyzing said firing order comprises calculating a thermal loss of at least one of said nozzles as a function of time.

14. A method of performing maintenance on a printer that is manually moved across a surface to print an image, said method comprising:

generating print instructions for said image that dictate when and where each of a plurality of nozzles will fire to print said image;

determining which of said plurality of nozzles requires a maintenance action as said printer prints said image; and including in said print instructions at least one instruction related to a performance of said maintenance action, wherein said step of determining which of said plurality of nozzles requires a maintenance action comprises assuming a minimal user printing speed to determine a time period between firings of each nozzle.

15. A method of performing maintenance on a printer that is manually moved across a surface to print an image, said method comprising:

generating print instructions for said image that dictate when and where each of a plurality of nozzles will fire to print said image;

determining, while printing said image, which of said plurality of nozzles requires a maintenance action; and including in said print instructions at least one instruction related to a performance of said maintenance action, said at least one instruction comprising including a print instruction that causes a nozzle to fire in a high density region of said image at least once to clear said nozzle.

16. A method of performing maintenance on a printer that is manually moved across a surface to print an image, said method comprising:

generating print instructions for said image that dictate when and where each of a plurality of nozzles will fire to print said image;

determining, while printing said image, which of said plurality of nozzles requires a maintenance action by assuming a minimal user printing speed to determine a time period between firings of each nozzle; and including in said print instructions at least one instruction related to a performance of said maintenance action.

17. A method of performing maintenance on a printer that is manually moved across a surface to print an image, said method comprising:

generating print instructions for said image that dictate when and where each of a plurality of nozzles will fire to print said image;

determining, while printing said image, which of said plurality of nozzles requires a maintenance action comprising using, for each of the plurality of nozzles, the following:

```
if (NozzleIdleTime>15)
  {
    P=k1(p_dnsity)+k2(p_others)+k3(p_temp)+k4(p_time);
    if (P>0.8)
      {
        FireNozzle ( );
      }
  }
```

where P is a probability to fire a particular nozzle, $p_{dnsity}$ is a density of a swath firing around a dot location, $p_{others}$ is a number of other maintenance dots at that time, $p_{time}$ is an idle time of the particular nozzle, $p_{temp}$ is a parameter associated with maintaining a predetermined target printhead temperature, and $k_1$, $k_2$, $k_3$ and $k_4$ are weightings on said $p_{dnsity}$, $p_{others}$, $p_{temp}$, and $p_{time}$ values;

and, including in said print instructions at least one instruction related to a performance of said maintenance action.

* * * * *

UNITED STATES PATENT AND TRADEMARK OFFICE

CERTIFICATE OF CORRECTION

PATENT NO. : 7,604,320 B2
APPLICATION NO. : 11/315449
DATED : October 20, 2009
INVENTOR(S) : Robertson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 717 days.

Signed and Sealed this

Fifth Day of October, 2010

David J. Kappos

David J. Kappos
*Director of the United States Patent and Trademark Office*